US006390175B1

(12) United States Patent
Fink et al.

(10) Patent No.: US 6,390,175 B1
(45) Date of Patent: May 21, 2002

(54) HOT CHAMBER DIE-CASTING MACHINE

(75) Inventors: Roland Fink, Winterbach; Norbert Erhard, Lorch; Herbert Noschilla, Schorndorf, all of (DE); Bruno Stillhard, St. Gallen (CH)

(73) Assignee: Oskar Frech GmbH + Co., Schorndorf (DE)

( * ) Notice: Subject to any disclaimer, the term of this patent is extended or adjusted under 35 U.S.C. 154(b) by 0 days.

(21) Appl. No.: 09/550,271

(22) Filed: Apr. 13, 2000

(30) Foreign Application Priority Data

Apr. 13, 1999 (EP) ..... 99106242
Jun. 24, 1999 (EP) ..... 99111960

(51) Int. Cl.[7] ..... B22D 17/02
(52) U.S. Cl. ..... 164/316
(58) Field of Search ..... 164/316, 284, 164/303, 312, 306, 309, 471, 493, 507, 513

(56) References Cited

U.S. PATENT DOCUMENTS 4,530,391 A * 7/1985 Fink et al. ..... 164/155
4,566,522 A * 1/1986 Fink et al. ..... 164/316
4,990,084 A * 2/1991 Reinhart ..... 425/590
5,266,874 A * 11/1993 Stillhard ..... 318/560
5,482,101 A * 1/1996 Fink ..... 164/312
5,565,224 A * 10/1996 Stillhard ..... 425/589
5,699,849 A * 12/1997 Fink ..... 164/155.4
5,960,854 A * 10/1999 Fink et al. ..... 164/316
6,321,826 B1 * 11/2001 Fink et al. ..... 164/316

FOREIGN PATENT DOCUMENTS

AT 292222 8/1971

OTHER PUBLICATIONS

Brochure, Osker Frech GmbH + Co., "Pressure Diecasting Machine" DAW 80S, Jun. 1994.

* cited by examiner

*Primary Examiner*—M. Alexandra Elve
*Assistant Examiner*—Kevin P. Kerns
(74) *Attorney, Agent, or Firm*—Crowell & Moring, LLP

(57) ABSTRACT

A hot chamber die-casting machine has drive assemblies in the form of electrical servomotors instead of hydraulic cylinders for driving and pressing a feed bush to the nozzle. The feed rate of the servomotors is adjustable. In order to avoid the influence of heat from the smelter and the furnace, the rotational axes of the servomotors located above the smelter and the furnace are connected through an angle drive to the spindle drive and aligned approximately vertically. This makes it possible to achieve a time-optimized and precise feed regulation that is independent of temperatures which develop.

12 Claims, 3 Drawing Sheets

HOT CHAMBER DIE-CASTING MACHINE

This application claims the priorities of European applications 991 06 242.3, filed Apr. 13, 1999, and 991 11 960.3, filed Jun. 24, 1999, the disclosures of which are expressly incorporated by reference herein.

BACKGROUND AND SUMMARY OF THE INVENTION

The present invention relates to a hot chamber die-casting machine with a gooseneck located in a metal bath within a smelter, with a vertical channel between the bottom of the sleeve and the seat of nozzle body with a mouthpiece and a nozzle mounted thereon as well as two drive assemblies having axes which are parallel to the nozzle. The assemblies are connected with a crossarm of a machine stand associated with the smelter and with a solid molding plate of a closing unit to which half of a mold is fastened, whose feed bush can be pressed against the nozzle tip during a casting process.

Known hot chamber die-casting machines which are on the market, like those manufactured and sold by the applicant, for example (Frech die-casting automatic machine DAW 80S "Druckvermerk" 06.94 KK), have a hydraulic drive in the form of two mutually parallel hydraulic cylinders, each engaging the mold on the solid mold plate, in order to advance the feed bush and press it against a nozzle tip. The cylinders are connected, on a side facing away from the mold plate, with a crossarm of the machine stand that spans the furnace and the crucible. This design is provided in order to permit moving and applying the feed bush to the mold at the nozzle tip with a given feed rate through the hydraulic system. The very high application force required during die casting can also be maintained by such drives. A certain disadvantage of this is that the hydraulic cylinders that usually run horizontally above the furnace grow hot; their regulating ability is also influenced by the variable viscosity of the hydraulic oil used, and this is taken into account.

It is also already known (AT-PS 292 222) to provide an electrical drive for a threaded spindle arrangement for closing a mold of an injection molding machine. Since molds of injection molding machines, and also molds of hot chamber injection molding machines, are not located in immediate vicinities of crucibles or furnaces which receive the hot metal melt, there are fewer problems with using electric motors than there are with advancing and retracting drives for feed bushes in hot chamber die-casting machines, in which these drives must necessarily be located directly in the areas of the hot melt.

One goal of the invention is to design a drive assembly for advancing a mold to a nozzle in such a fashion that feed regulation that is as time-optimized and precise as possible, and which is independent of temperatures developing in such die-casting machines, can be achieved.

To achieve this goal, in a hot chamber die-casting machine of the type mentioned above, the drive assembly is designed as a linear drive driven by electric servomotors with feed rates which can be controlled. This design makes a very delicate adjustment of the feed bush to the nozzle to the mold with varying speeds possible without any influence from the changing viscosities of hydraulic oil. A high adjustment rate combined with a delicate adjustment largely correspond to an optimum process so that a considerable improvement over known hydraulic systems is achieved.

Especially advantageously, the influence of heat from the crucible and the furnace is avoided by having the rotational axes of the servomotors located above the crucible and the oven connected to the linear drive through an angle drive and aligned approximately vertically. By this measure, the servomotors are located as far as possible from the furnace and brought into a position in which the heat flow from the oven or crucible is as small as possible. The angle drive located closer to the furnace provides a certain amount of heat insulation and can additionally be provided with a layer of insulation. The linear drive can be designed as a spindle drive and may additionally be surrounded by a continuous cooling jacket as well. It is also possible to equip the servomotors with water cooling. A rack and pinion drive can also form the linear drive, although a spindle drive has proven advantageous.

To obtain good travel of the spindle drive, a roll spindle or ball screw arrangement, which itself is known, can also be provided and may have a pitch which is made so that it has a self-locking effect. Consequently, unintentional feed or retraction of the drive is prevented, and the necessary retaining pressure can also be maintained during the die-casting process. Of course, corresponding locking devices can also be provided. In addition, the engine load moments are controlled so that a reliable closure between the feed bush and the nozzle tip is ensured.

According to one feature of the invention, the servomotors can be operated at different rates, with the arrangement being made such that the feed rate of the drive shortly before the application of the nozzle tip is reduced considerably relative to the feed rate. In this manner, it is possible to bring the feed neck against the nozzle tip in a precisely regulated fashion. As a result, wear at this point can be largely avoided. It is known to harden the nozzle tip, and the nozzle tip abuts the feed bush over a very small contact area. If the impact is too hard, damage can occur to the nozzle tip; this damage is avoided by the design of the invention.

An embodiment of the invention is shown in the drawings and is explained below.

DESCRIPTION OF THE PREFERRED EMBODIMENTS

Figure 1:
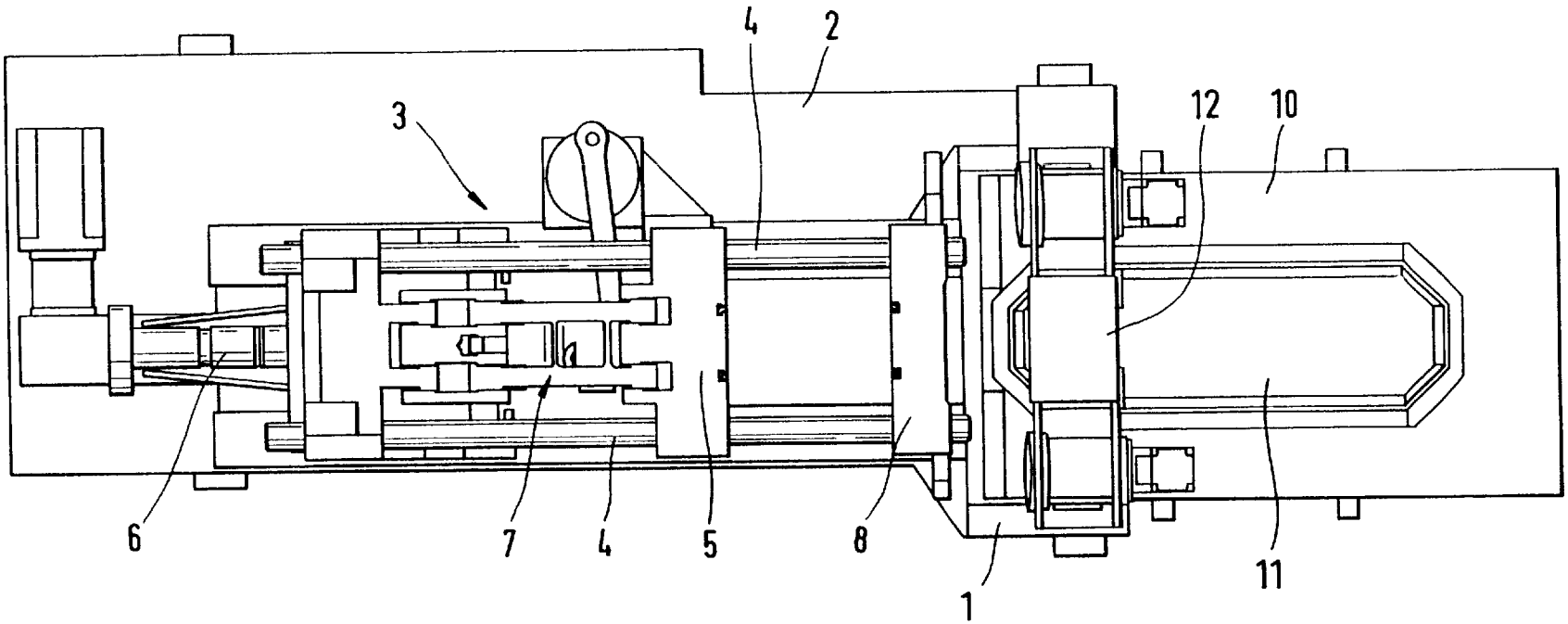
FIG. 1 is a schematic top view of a hot chamber die-casting machine according to the invention.
Figure 3:
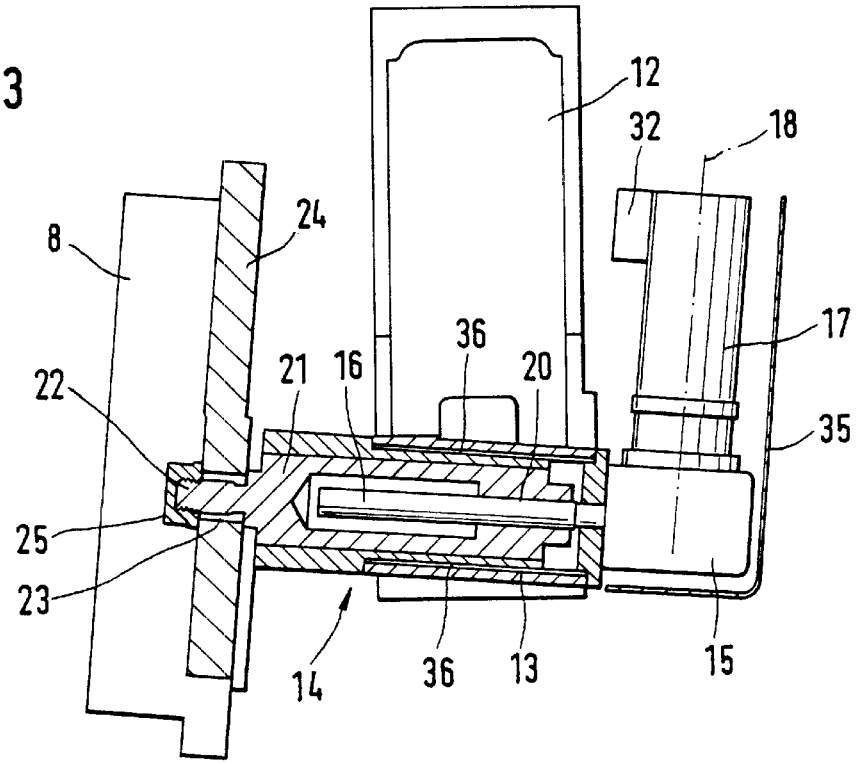
FIG. 3 is a section through the device shown in FIG. 2 along line III—III.
Figure 4:
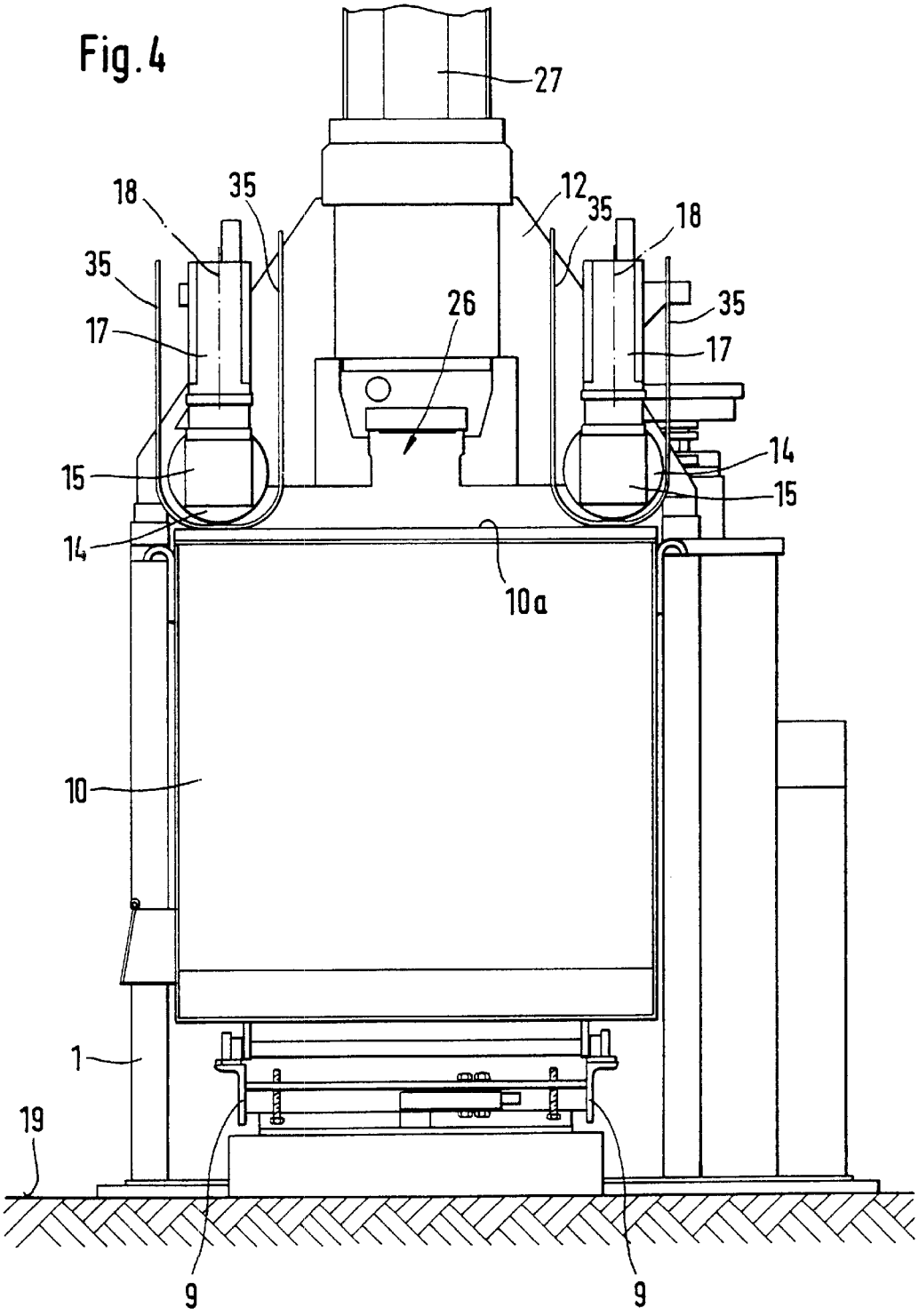
FIG. 4 is a view of the device shown in FIG. 2 as seen in the direction of arrow IV.

FIG. 1 shows a hot chamber die-casting machine on an underframe 1 designed as a machine stand and located above a machine pedestal 2. On the left side, the closing part 3 of the machine has guide rods 4 for a movable mold clamping plate 5 with an adjusting drive 6, and a toggle lever closing mechanism 7, which itself is known, and a fixed solid mold clamping plate 8 are also provided. A furnace 10, movable on rails 9 (FIG. 4) with a smelter 11, is located on this fixed mold clamping plate 8. The smelter is spanned by a crossbar 12. On the crossbar (see FIGS. 2 and 3), the outer cylindrical housing 13 is fastened by two spindle drives 14 located parallel to one another. An angle drive 15 is also permanently connected with the housing 13 and has a spindle 16, projecting centrally into the housing, designed as a roll spindle or ball screw spindle. This spindle 16 is driven by an electrical servomotor 17 whose rotational axis 18 is aligned approximately perpendicularly to the surface 10*a* of furnace 10 (FIG. 4) and hence approximately vertically to the mounting surface 19 of the hot chamber die-casting machine. The two servomotors 17 are controlled in synchronization with one another so that the mold clamping plate 5 can be moved exactly parallel. Unequal application of force by the two spindle drives is ruled out.

A spindle nut 21 with a counterthread 20 adapted to the spindle 16 is in mesh with the spindle 16. The nut (see FIG. 3) penetrates, with a threaded pin 22, an opening 23 in a lateral flange area 24 of the fixed mold plate 8 and is fastened there by a nut 25. If spindle 16 is rotated, a relative movement occurs between the furnace equipped with crossbar 12 and its smelter 11 and the fixed mold clamping plate 8.

Figure 2:
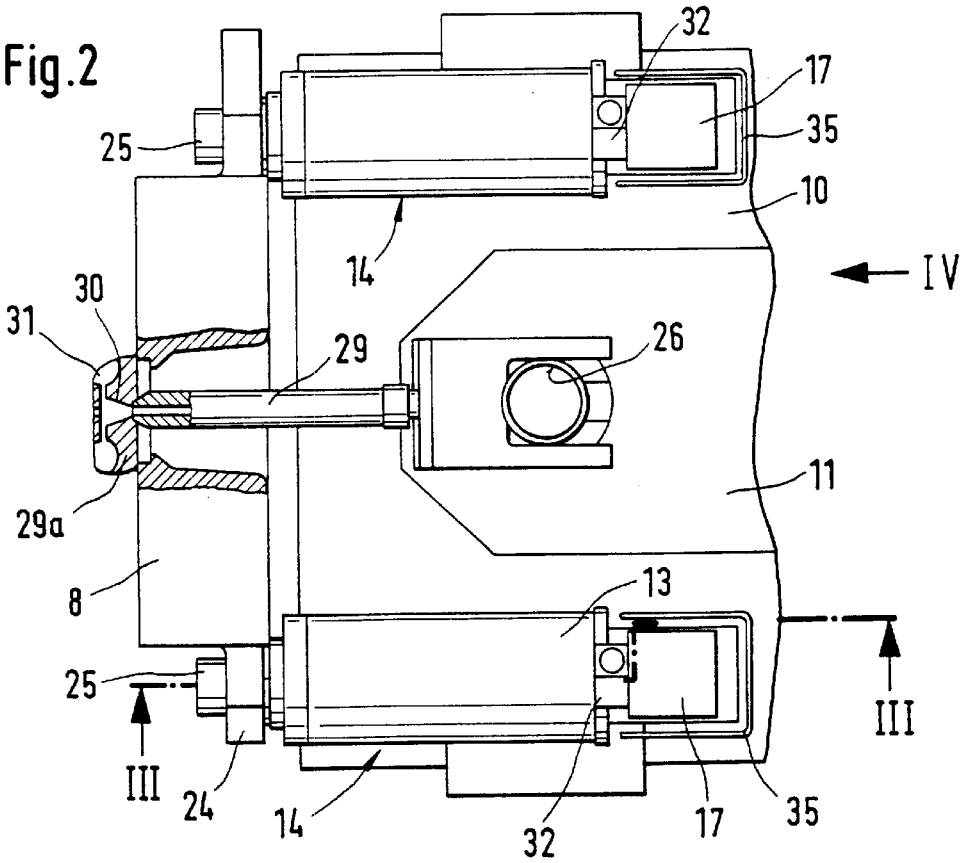
FIG. 2 is an enlarged partially cut away view of the area of the portable furnace with the drive assemblies and the solid die plate.

As can be seen from FIG. 2, a casting container 26 is submerged in known fashion into smelter 11. The casting container is contacted from above by the crossbar 12 with a piston drive 27 for a piston that dips into the casting container 26 but is not shown in greater detail. This casting container 26, in the area within the melt located in smelter 11, has a rise tube which is directed approximately parallel to the casting container 26 upward from the end of the casting container and has a nozzle 29 mounted on its mouth. This nozzle 29, in the position of the die-casting machine shown in FIGS. 2 and 3, abuts, by way of its tip 29*a*, the feed bush 30 of the casting mold 31, shown only schematically, and is held in this position as long as liquid metal is forced from casting container 26 outward through the vertical channel between the bottom of the sleeve and the seat of nozzle body and through nozzle 29 into the mold. The mold 31 is then moved away to the left from nozzle 29 and returned to the position shown in FIG. 2 only for a new die-casting process. For this purpose, the spindle 16 is rotated by servomotors 17 so that threaded nut 21 moves outward to the left from the housing 13 so that the distance between the cooled feed bush 30 and the heated nozzle tip 29*a* becomes sufficiently large to produce an air insulation bridge between two components. By this measure, the position of the melting zone of the setting metal can be regulated. The travel and the adjustment rate are set so that no cycle time losses occur.

The total travel of the outward movement is used for repair and service purposes on nozzle 29, casting container 26, and nozzle tip 29*a*, and for the assemblies that are necessary for the method technology in this area.

As the figures indicate and as was described, the axes 18 of the servomotors 17 are aligned approximately vertically and the servomotors abut the spindle 16 through an angle drive 15. This design permits the electrical servomotors 17 to be located as far away as possible from the surface 10*a* of furnace 10 and the smelter. The effect of heat from the furnace, therefore, can be largely eliminated so that it is possible to use electrical servomotors that can be regulated very precisely over various speed ranges, even for the rough operation of a hot chamber die-casting machine, as drives for moving the nozzle in and out. By using water-cooled servomotors 17, additional heat-conducting panels 35, and an integrated cooling jacket 36, the heat radiated from the furnace is reduced to such a point that it has no disadvantageous effects on the function of the drives.

It is also possible to heat insulate angle drive 15 with, for example, external heat insulation so that having the angle drive 15 lie, in the direction of a heat flow, in front of servomotors 17 serves as protection for the servomotors and their electrical connections 32. These connections are located at the extreme upper ends of servomotors 17 and hence as far as possible from the heat source.

With the selected type of drive it is possible to bring the feed bush 30, initially, very quickly to the nozzle 29 and then, by appropriate reduction of the feed rate, make the approach to nozzle tip 29*a* very slow and precise in order to avoid any damage to the nozzle tip or the mold. This can be achieved by regulating the two spindle drives which, when they approach (and also when they move away), utilize a so-called "target braking" on the system point. The system point is determined in a search process. The adjustable pressure force is then developed by torque regulation of the motors. This device, therefore, makes it possible to adapt the pressure force required for the melt in the mold and to perform such an adaption or adjustment by way of a mathematical formula.

The threads of the spindle 16 and the counterthread 20 of the spindle nut 21 can be designed so that they are self-locking. After the feed bush 31 is applied to nozzle tip 29*a* and the drives are shut off, the nozzle can be held in a stable and permanent fashion in its operating position, so that, naturally, the adjustment must be designed for the drive thread to the high forces expected during die casting. The motor load torques are also balanced so that a more reliable seal between the feed bush and the nozzle tip is ensured.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Hot chamber die-casting machine comprising:

a casting container in a metal bath within a movable smelter which is equipped with a vertical channel between the bottom of a sleeve and a seat of a nozzle body with a mouthpiece and a nozzle mounted on the mouthpiece, two drive assemblies having axes thereof which are parallel to the nozzle, and a crossbar of a machine frame to which the drive assemblies are connected, the crossbar associated with said movable smelter and with a solid mold plate of a closing unit to which a half of a mold is fastened, said mold having a filler bush which, during a casting process, can be pressed against a nozzle tip of said nozzle, wherein the drive assemblies are linear drives driven by electrical servomotors with a feed rate which can be regulated.

2. Hot chamber die-casting machine according to claim 1 wherein both drive assemblies are regulated synchronously.

3. Hot chamber die-casting machine according to claim 1 wherein the drive assemblies include spindle drives which are provided as linear drives.

4. Hot chamber die-casting machine comprising:

a casting container in a metal bath within a movable smelter which is equipped with a vertical channel between the bottom of a sleeve and a seat of a nozzle body with a mouthpiece and a nozzle mounted on the mouthpiece, two drive assemblies having axes thereof which are parallel to the nozzle, and a crossbar of a machine frame to which the drive assemblies are connected, the crossbar associated with said movable smelter and with a solid mold plate of a closing unit to which a half of a mold is fastened, said mold having a filler bush which, during a casting process, can be pressed against a nozzle tip of said nozzle, wherein the drive assemblies are linear drives driven by electrical servomotors with a feed rate which can be regulated, and wherein each of said drive assemblies is located above a furnace that receives said smelter and wherein each of the servomotors is connected through an angle drive with a linear drive and has a rotational axis which is aligned approximately vertically.

5. Hot chamber die-casting machine according to claim 4 wherein the angle drive is equipped with heat insulation.

6. Hot chamber die-casting machine according to claim 5 wherein the drive assembly and the angle drive are provided with surrounding heat-conducting panels for heat insulation.

7. Hot chamber die-casting machine according to claim 5 wherein the drive assemblies are provided with an integrated cooling jacket.

8. Hot chamber die-casting machine according to claim 3 wherein each spindle drive is provided with a roll spindle or a ball screw spindle.

9. Hot chamber die-casting machine according to claim 8 wherein a pitch of the thread of the roll spindle or ball screw spindle and of the counterthread are designed so that the thread and the counterthread are self-locking.

10. Hot chamber die-casting machine according to claim 1 wherein the servomotors are so designed, and can be controlled in such fashion, that a feed rate of the filler bush, shortly before contacting the nozzle tip, is reduced relative to an initial speed.

11. Hot chamber die-casting machine according to claim 10 wherein braking is provided to regulate the feed rate of the filler bush on starting and when retracting.

12. Hot chamber die-casting machine according to claim 2 wherein the drive assemblies include spindle drives which are provided as linear drives.

* * * * *